US010018037B2

(12) United States Patent
Lindfors

(10) Patent No.: US 10,018,037 B2
(45) Date of Patent: Jul. 10, 2018

(54) SAMPLING APPARATUS

(71) Applicant: ERIMEK OY, Vantaa (FI)

(72) Inventor: Erik Lindfors, Vantaa (FI)

(73) Assignee: ERIMEK OY, Vantaa (FI)

( * ) Notice: Subject to any disclaimer, the term of this patent is extended or adjusted under 35 U.S.C. 154(b) by 617 days.

(21) Appl. No.: 14/644,754

(22) Filed: Mar. 11, 2015

(65) Prior Publication Data

US 2015/0184509 A1 Jul. 2, 2015

Related U.S. Application Data

(63) Continuation of application No. PCT/FI2013/050872, filed on Sep. 10, 2013.

(30) Foreign Application Priority Data

Sep. 19, 2012 (FI) ..... 20125965

(51) Int. Cl.

| | |
|---|---|
| ***E21B 49/02*** | (2006.01) |
| ***E02D 1/02*** | (2006.01) |
| ***E21B 21/01*** | (2006.01) |

(52) U.S. Cl.

CPC ..... *E21B 49/02* (2013.01); *E02D 1/02* (2013.01); *E21B 21/01* (2013.01)

(58) Field of Classification Search

CPC .. E02D 1/025; E02D 1/02; E02D 1/04; E21B 2021/007; E21B 21/01

See application file for complete search history.

(56) References Cited

U.S. PATENT DOCUMENTS

| | | | |
|---|---|---|---|
| 1,985,157 | A | 12/1934 | Friedman et al. |
| 3,442,337 | A | 5/1969 | Osten Astrom |
| 4,332,301 | A | 6/1982 | Jonell |
| 4,444,280 | A | 4/1984 | Howeth |
| 6,332,308 | B1 | 12/2001 | Miller |

(Continued)

FOREIGN PATENT DOCUMENTS

WO WO 2010/000040 A1 1/2010

OTHER PUBLICATIONS

Extended European Search Report issued by the European Patent Office in relation to European Patent Application No. 13838148.8-1605 dated Dec. 2, 2016 (5 pages).

(Continued)

*Primary Examiner* — D. Andrews

(74) *Attorney, Agent, or Firm* — Robert P. Michal, Esq.; Carter, DeLuca, Farrell & Schmidt, LLP

(57) ABSTRACT

A sampling apparatus for collecting geological samples from the subsurface is fixable to a drill, such as to a mining drill rig. The drill apparatus includes a chassis, and a drill comprising a boring pipe and a drill bit. The sampling apparatus is fixable to the chassis of the drill apparatus and includes a sampling pipe arrangement to be fitted to the end of it, as well as a collecting apparatus to be connected to the sampling pipe apparatus, in which the collecting apparatus samples can be collected. The nozzle is a suction nozzle, in which suction is arranged. The sampling pipe arrangement comprises an attitude adjustment apparatus, with which the nozzle can be arranged into the proximity of the boring pipe in such a way that the nozzle is near the borehole and the mouth of it is directed towards the borehole such that it is able to take samples directly from the mantle rock flying out from the borehole.

9 Claims, 4 Drawing Sheets

(56) References Cited

U.S. PATENT DOCUMENTS

| | | | |
|---|---|---|---|
| 6,845,657 | B2 | 1/2005 | Williams |
| 2009/0178853 | A1 | 7/2009 | Pavlik |
| 2010/0320000 | A1 | 12/2010 | Sormunen |

OTHER PUBLICATIONS

PCT Search Report dated Dec. 16, 2013 which was issued in a related PCT International Patent Application No. PCT/FI2013/050872 (3 pages).

SAMPLING APPARATUS

CROSS REFERENCE TO RELATED APPLICATION

This application is a Continuation of PCT International Patent Application No. PCT/FI2013/050872 filed on Sep. 10, 2013, which claims the benefit of Finnish Patent Application No. 20125965 filed Sep. 19, 2012, the entire disclosure of each of which is incorporated herein by reference in its entirety.

FIELD OF THE INVENTION

The object of the invention is an apparatus intended for collecting geological samples, which apparatus is suited e.g. for underground drilling use.

BACKGROUND OF THE INVENTION

The excavating of ore or other minerals is performed typically at mines by drilling and by loading a number of pluralities of deep holes in an advantageous grouping in terms of the blasting technique. Compressed air, or a compressed air-water mix, blown via the boring pipe is used in drilling the deep holes to transport the rock material that is detached by the drill bit out of the hole. Due to the action of the compressed air, rock material typically flies into a small heap around the borehole. The ore being sought is not evenly distributed in the bedrock of the mining area, but instead adjoining rock formations having a smaller or non-existent ore content are mixed up with the ore deposit. The excavation of encasing rock cannot be avoided, but it is worth minimizing the progression of the encasing rock into the crushing phases and ore cleaning phases. From the viewpoint of the ore cleaning process, it is advantageous to know in advance as accurately as possible the grade of the crushed ore material entering the process. The grade of the ore material in the ore intended to be excavated is first ascertained with trial boring and in the production drilling stage by collecting rock samples, into sample bags with a shovel, from the piles of rock material produced around the boreholes in the drilling. The sample collecting work is performed manually and requires an employee to move about the drilling field. Drilling field conditions are typically dusty and the nature of the flying dust detaching from the piles can be detrimental to the health of the employee collecting the samples. From the collected samples a sample is made by splitting a number of times, from which sample the content of the target minerals is determined. A weakness with pile samples is that it is no longer possible to ascertain from the rock material taken from a pile information about the depth of adjoining rock deposits or ore deposits from the drilling level. A sample taken from a pile represents a sort of hole average. It is also known in the art that some of the target mineral has possibly escaped along with the finer material carried by the wind, so remaining in the pile is a higher proportion of adjoining rock in relation to the target mineral. Known solutions to the problem are to install on the boring pipe a collar, or suchlike system, covering the whole borehole to collect rock material coming out of the hole and to split the whole amount of material a number of times, automatically or manually, or to install on the collar a flow guide and turn part of the flow into a separate bag functioning as a sample collector.

Publication U.S. Pat. No. 4,650,013 presents a subsurface sampling apparatus, by means of which subsurface samples can be taken from a hole drilled in the ground. It has a bag-like collection container, in which the subsurface samples are collected. The subsurface samples are fed into the collection container via a mouth piece that is in an inclined attitude on the edge of a vertical pipe. The area of the borehole is covered with an elastic cover.

Particular drawbacks in sampling apparatuses according to prior art are poor sampling accuracy and the complex structure of the apparatus.

SUMMARY OF THE INVENTION

The aim of the present invention is thus to eliminate, inter alia, the aforementioned drawbacks of prior-art solutions, and to achieve an apparatus with which a more truly representative sample than before with respect to sampling of the excavated ore can be produced. Further, the aim of this invention is to bring about the following advantages: to achieve a better level in sampling accuracy, to achieve savings in the labor costs in sampling, and to achieve a better work safety level and work hygiene level in sampling.

The invention is based on the concept that a geological sample is taken from the air that is discharging from a borehole and that contains rock material, from as close to the mouth of the borehole as possible without covering the hole with a collar or with a rubber protector. In addition, the size of a sample is limited, preferably already at the point of the mouth aperture of the borehole, to be small but to be highly representative of the bedrock by collecting the sample from the rock material flying out of the hole.

In the concept according to the invention an advantageously shaped suction nozzle connected to a pipe is taken to near the mouth of the borehole and negative pressure is connected to it. A negative pressure point in the outflowing field of the borehole collects rock material that has flown out of the hole and struck its surface area. This material also contains a fraction of fine-grained rock material flying out along with the wind.

Only a part of the whole flow of rock material plus air coming from the hole flies into the sampling aperture on the frontal surface area. Selecting the size of the aperture advantageously achieves the benefit that less post-processing of a sample by splitting, or with another such method, is needed or is not needed at all. The representativeness of a sample is better than that of methods known in the art, because the sample contains also particles normally escaping as airborne dust.

Cyclones, filters, or combinations of cyclones and filters, or other such dust separation methods generally known in industry, can be used as methods for separating the rock material and air, however in such a way that the rock material in the separating system does not mix in the separating process with the rock material that came earlier from the borehole. This is important because the part of the material that is closest to the surface collects at the bottom of the sample bag and last of all comes the part of the rock material from the bottom of the borehole.

The apparatus according to the invention includes a sampling pipe provided with a suction nozzle and a collecting apparatus, in which a number of samples of the borehole can be preserved for collection for further periodic analyses.

The apparatus according to the invention is further characterized in that the sampling apparatus includes an adjustment apparatus, with which the nozzle can be fitted next to the drill bit in such a way that the nozzle is near the borehole and the mouth of it is directed towards the borehole in such a way that it is able to take samples directly from the mantle rock flying out from the borehole.

The suction nozzle is shaped in such a way that it protects the rest of the structure of the sampler from wear by rock material flying out of the hole by guiding the air coming out of the borehole to pass by the side of the support structures of the suction nozzle.

In the immediate proximity of the suction nozzle is a flow amplifier producing negative pressure and transferring a sample by means of positive pressure into the collecting apparatus.

The position of the suction nozzle can be shifted if inclined holes are drilled, so that the sampling location remains the same or almost the same.

The solution according to the invention is described in detail in the appended claims.

BRIEF DESCRIPTION OF THE DRAWINGS

In the following, the invention will be described in detail by the aid of some embodiments with reference to the attached drawings, wherein.

DETAILED DESCRIPTION

Figure 1:
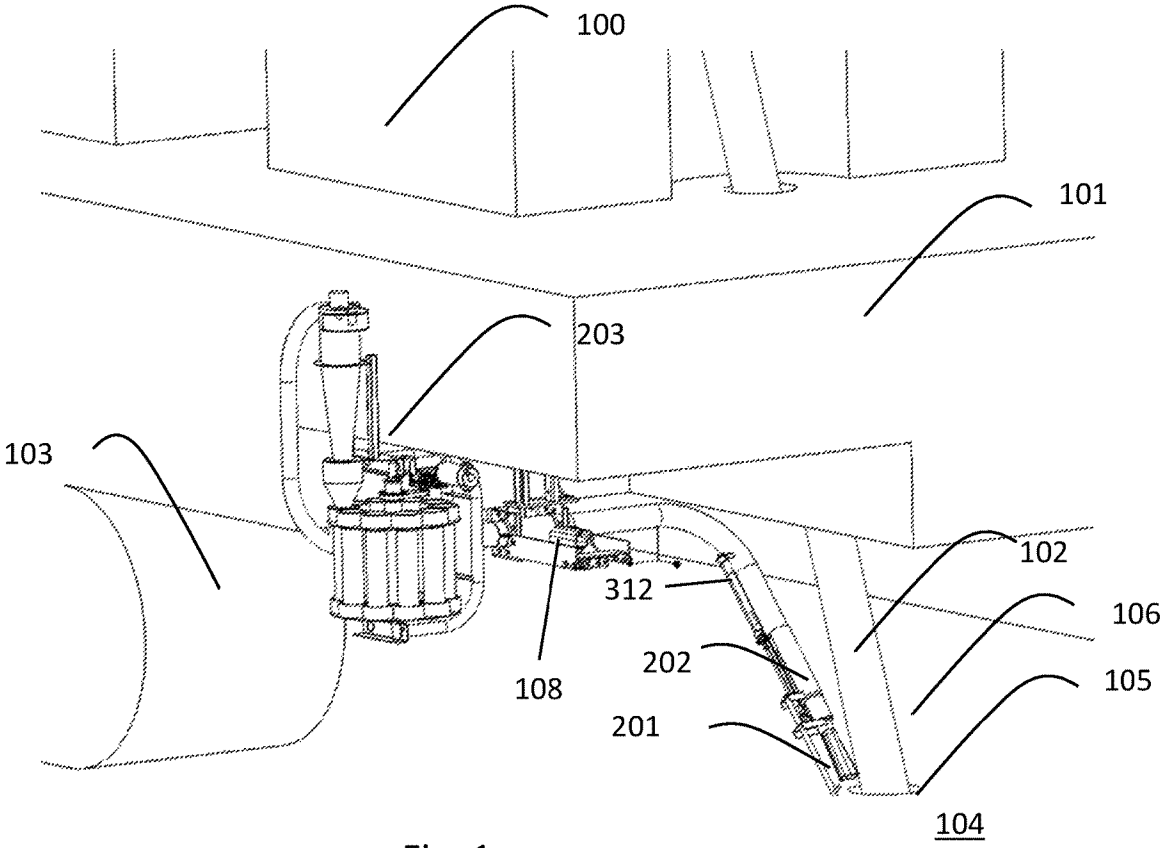
FIG. 1 presents a front view of a drill rig in which is a sampling apparatus according to the invention.

FIG. 1 presents a simplified view of a mobile crawler-tracked drill rig 100 used in open-cast mines, said rig including a chassis 101, and a drill fitted into the rig, said drill including an extendable boring pipe 102 and a drill bit (not presented) on the end of it. The drill rig according to FIG. 1 includes motor-driven crawler tracks 103, by the aid of which the drill rig can be moved in the mining area. In addition, the drill rig 100 includes a control unit 108 for controlling it.

Holes 105 are bored in the ground 104 with the drill, from which holes rock material 106 discharges out of the borehole onto the surface of the ground. The apparatus according to FIG. 1 is used in drilling deep boreholes, in which case compressed air, or a compressed air-water mix, is blown via the stem 102 of the drill bit to transport the rock material that is detached by the drill bit out of the hole.

For sampling the drill rig includes a sampling apparatus, according to the invention, that is provided with a control unit 108, which sampling apparatus is fixed below the chassis of the rig. The control unit 108 can be separate or, on the other hand, it can be integrated into the control system of the drill rig. The sampling apparatus includes sampling pipe 202 having the additional parts described later and provided with a nozzle 201, as well as a collecting apparatus 203, in which the samples are collected. The samples are taken from the borehole made with the drill rig.

With the sampling apparatus according to the invention a geological sample is taken from the air that is discharging from a borehole 105 and that contains rock material 106 from as close to the mouth of the borehole as possible without covering the hole with a collar or with a rubber protector.

Figure 2:
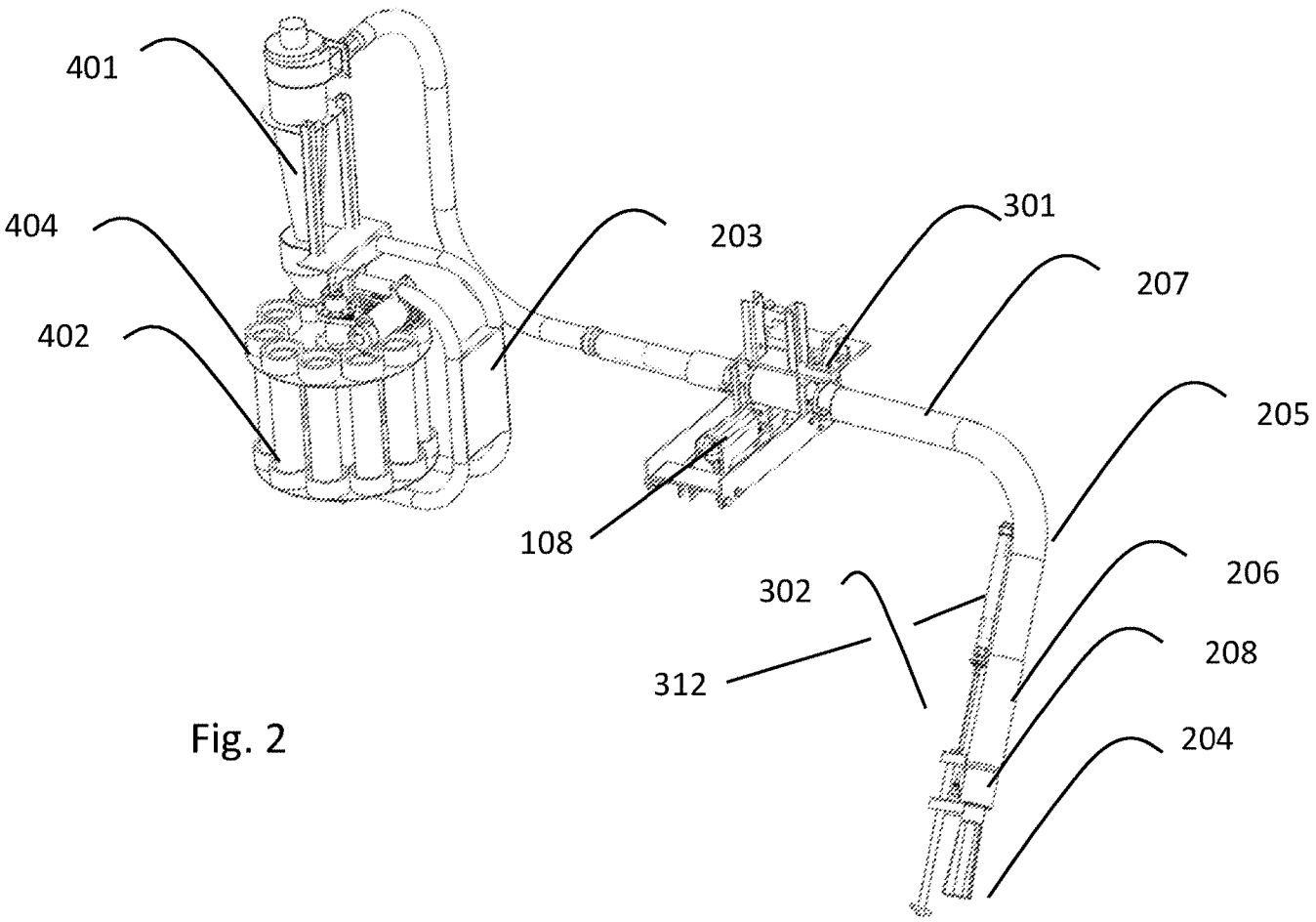
FIG. 2 presents a sampling apparatus according to the invention.
Figure 3:
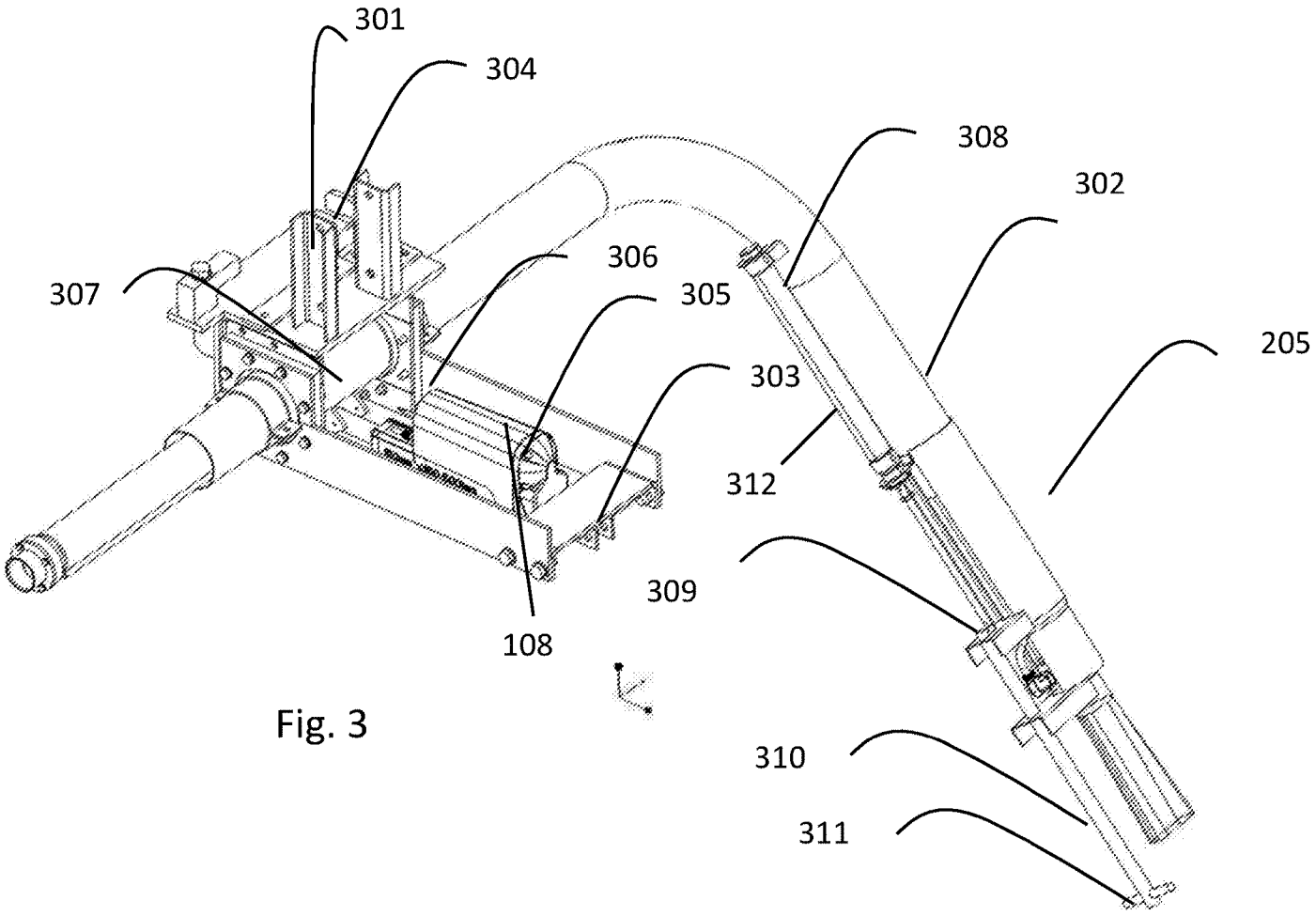
FIG. 3 presents a sampling pipe and the adjustment apparatuses of it.

The sampling apparatus is described in more detail in FIGS. 2 and 3.

So that the sample can be taken from as close as possible to the borehole 105, the nozzle 201 is a suction nozzle, in which is suction, and it is shaped in such a way that it has a shape expanding like a horn towards the bottom end, i.e. towards the mouth 204, of the nozzle and it can be fixed, in a manner allowing adjustment, to the bottom end if the sampling pipe 202 near the borehole (FIG. 1). The surface area of the bottom end of the suction nozzle is relatively small compared to the borehole, in which case the size of a sample is limited already at the point of the mouth aperture of the borehole to be small but to be highly representative of the bedrock. In addition, the material of the suction nozzle is wear-resistant rubber, polyurethane or ceramic.

According to FIGS. 2 and 3, the sampling pipe 202 is disposed on a rigid bent metal pipe 205, said metal pipe 205 including a protective pipe or first pipe part 206 in the direction of the drill bit or at a small angle, of less than 45, preferably of less than 30, degrees to it, as well as a second pipe part 207 in the direction of the chassis 101 of the drill rig 100. The suction nozzle 201 is fixed to the bottom end of the first pipe part 206 of the sampling pipe 202. Additionally, a flow amplifier 208 is in the bottom part of the first pipe part 206. With the flow amplifier 208 the suction of the suction nozzle 201 is brought about and also at the same time positive pressure for the parts of the sampling pipe 202 after the flow amplifier 208, which boosts the passage of rock material in the sampling pipe 202.

The attitude of the sampling pipe and the length of the first pipe part can be adjusted, in which case the suction nozzle can be positioned near the borehole, and when the drill bit is inclined when drilling inclined holes also for disposing the first pipe part in an inclined attitude to correspond to the inclined attitude of the drill bit.

For this purpose the metal tube surrounding the sampling pipe can be turned with the turning apparatus 301 and the length can also be adjusted with a length adjustment apparatus 302 provided with a ground plane sensor.

The turning apparatus 301 turns the sampling pipe 202 in such a way that the first straight pipe part 205 is turned by means of it to a suitable angle with respect to the drill bit. The turning apparatus 301 includes a casing (not presented) and a frame 303 and also brackets 304 for fixing it to the chassis frame 101. For turning the pipe there is a controllable actuator or spindle motor 305, the spindle 306 of which is fixed to a flange-shaped part 307 attached to the second pipe part 207. Turning the second pipe part 207 around its center axis turns at the same time the nozzle 201 at the end of the first pipe part 206, and the nozzle 201 can be fitted to be close to the borehole 105. In addition, the turning apparatus 301 can include a control part, such as an indication means 312 for determining the angle of the first pipe part 206 with respect to the drill bit. It is contemplated that the spindle motor 305 can turn the second pipe part 207 according to the inclination of the boring pipe 102 which has been determined by the indication means 312.

For the length adjustment of the first pipe part 206 the apparatus includes a length adjustment apparatus 302, in which is a pneumatic or hydraulic cylinder 308, including a piston rod 309 and a sensing means or sensor pin 310 connected to its end. In addition, the pressure line controlling the cylinder includes a pressure sensor.

The adjustment apparatus functions as follows:

The control logic of the sampling apparatus receives data about the turning angle of the drilling rod and adjusts with the spindle motor the turning angle of the sampler to suit the location of the drill when the drilling cycle starts. The control logic controls the hydraulic cylinder 308 to push the piston outwards at a suitable speed. The piston rod 309 is fixed to the nozzle 201 and to the sensor pin 310. When the pin touches the ground, its travel is prevented or becomes more laborious and the increase in the power requirement can be detected e.g. with a pressure sensor connected to the pressure line. The control logic disconnects the pressure supply when the set pressure level is reached or the piston is in the end position.

The ground-level sensor pin includes a cross pin 311 for the purpose that there is a high probability that the cross pin will encounter rock and prevents the pin from jamming in a gap in the rock or sinking into loose sand. The narrow cross pin does not, on the other hand cling strongly to the pile of drilling cuttings but instead with a pulling movement comes out of the pile when the hole is completed.

In addition, the apparatus includes a collecting apparatus 203, which can include a cyclone 401 separating the rock material and the air, and a rotating sampling magazine 402 as well as the sample bags 403 arranged on its rim. The feed-in into the sample pipes occurs by rotating the magazine 402 with a rotating machine filling a sample bag 403 at the point of the top feeder hopper 404, from which the rock material is fed into a sample bag.

It is advantageous to select plastic film as the material of the sample bags, which enables rapid analysis of samples with the XRF method and with portable devices before more time-consuming conventional analysis. It is also advantageous to select the shape of a sample bag to be elongated so that the material that has come from different points of the borehole can be analyzed visually or with the aforementioned method utilizing X-ray fluorescence.

In underground drilling it is also possible to drill holes that are inclined, and not at a right angle, with respect to the ground surface. This property is made to bores for reasons of blasting technique. From the viewpoint of sampling technology, therefore, it is essential that the sampler is able to follow an inclined drilling rod and to take a sample always from the same point in relation to the borehole.

Figure 4:
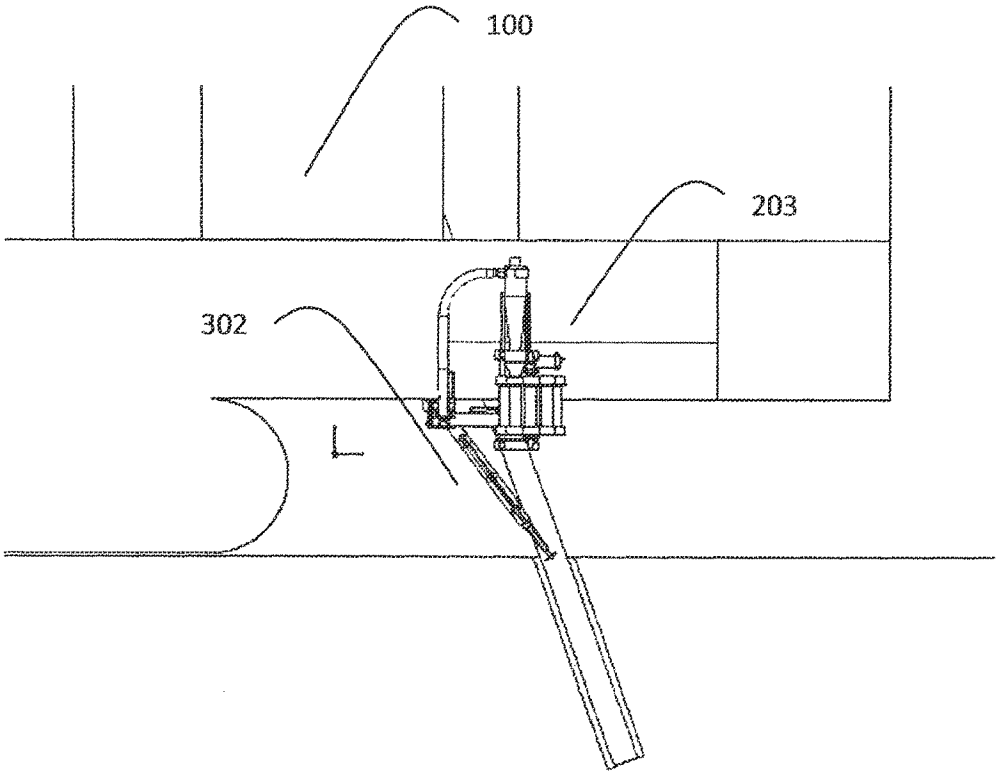
FIG. 4 presents a sampling apparatus according to the invention in more detail disposed according to an inclined borehole.

According to the invention the sampling pipe can be inclined at the pipe sections 205, 206 and the length can be adjusted so that the sampling location stays in the immediate proximity of the borehole according to FIGS. 1 and 4.

A preferred method of producing the negative pressure needed by the sampling is to bring about negative pressure as close as possible to the suction point. If the negative pressurized pipe is long, various flow resistances such as pipe bends and constrictions, as well as leaks, significantly weaken the amount of negative pressure at the suction point. Flow amplifiers are generally used in the pneumatic conveying of powdery substances to convey a mix of solids and air long distances using positive pressure. It is typical of a flow amplifier that it forms negative pressure on the suction side and the flow after the amplifier is positive pressurized. It is advantageous in the sampling to use a flow amplifier near the suction aperture. The section with negative pressure remains short and solid matter does not collect in the conveying pipe when the flow speed is maintained with a flow amplifier.

It is obvious to the person skilled in the art that the different embodiments of the invention are not limited solely to the examples described above, but that they may be varied within the scope of the claims presented below. The sampling apparatus presented above functions in a turning angle-radius coordinate system. An alternative method of implementing it is straight-line movement according to an x and y coordinate system. The first pipe part can, instead of being straight in shape, also be slightly curved, however in such a way that the end of it nearest the borehole is in the direction of the boring pipe or at an angle of less than 45 degrees inclination with respect to the boring pipe.

The invention claimed is:

1. A sampling apparatus for collecting geological samples from a subsurface, which sampling apparatus is fixable to a drill apparatus, which comprises a chassis, and a drill, said drill comprising a boring pipe and a drill bit, wherein the sampling apparatus is fixable to the chassis of the drill apparatus, wherein the sampling apparatus comprises a sampling pipe arrangement and a nozzle fitted to an end of the sampling pipe arrangement, and a collecting apparatus connected to the sampling pipe arrangement, wherein collecting apparatus samples can be collected, wherein the nozzle is a suction nozzle, in which suction is arranged, the sampling pipe arrangement comprises an attitude adjustment apparatus, with which the nozzle can be arranged into the proximity of the boring pipe such that the nozzle is near a borehole and a mouth of the nozzle is directed towards the borehole such that the nozzle is able to take samples directly from rock material flying out from the borehole, wherein a part of the sampling pipe arrangement near the boring pipe comprises a first pipe part, wherein the nozzle is fixed to a bottom end of the first pipe part such that at least the bottom end of the first pipe part including the nozzle is parallel with the boring pipe or at an angle of less than 45° to the boring pipe, wherein the length of the first pipe part is adjusted for fitting the nozzle close to the borehole using length adjustment apparatus.

2. The sampling apparatus according to claim 1, wherein the sampling apparatus comprises a suction device operatively arranged in the sampling pipe arrangement for providing suction in the nozzle.

3. The sampling apparatus according to claim 1, wherein the sampling pipe arrangement comprises near the mouth of the nozzle a flow amplifier, with which negative pressure bringing about suction can be formed in the nozzle and positive pressure in the sampling pipe arrangement after the flow amplifier for boosting the flow.

4. The sampling apparatus according to claim 1, wherein the attitude adjustment apparatus comprises indication means and one of a turning apparatus and a transfer apparatus for adjusting the first pipe part according to one of the inclination and the attitude of the boring pipe determined by the indication means.

5. The sampling apparatus according to claim 4, wherein a sampling pipe in the sampling pipe arrangement is at least partly fitted inside a protective pipe, wherein the sampling pipe or protective pipe comprises at least near the boring pipe the first pipe part, in connection with an end nearest the borehole of which the nozzle is fixed, the adjustment apparatus in which the sampling pipe arrangement is configured to turn or to transfer the nozzle near the first pipe part.

6. The sampling apparatus according to claim 1, further comprising a turning apparatus comprising indication means for determining the inclination of the boring pipe as well as a controllable actuator to turn the first pipe part according to the inclination of the boring pipe defined with the indication means.

7. The sampling apparatus according to claim 1, wherein for the length adjustment the apparatus comprises a sensing means to indicate the distance of the nozzle from the ground as well as control means to adjust the length of the first pipe part.

8. The sampling apparatus according to claim 1, wherein the apparatus comprises a cylinder arrangement, which is configured to function in such a way that the sampling apparatus controls cylinders of the cylinder arrangement to move a piston rod, which piston rod is fixed to the nozzle and to a sensing means for sensing the distance of the nozzle from the ground.

9. The sampling apparatus according to claim 8, wherein a control unit of the sampling apparatus is configured to function in such a way that it controls the cylinders of the cylinder arrangement to move the piston rod outwards, and when the sensing means touches the surface of the ground, its passage is at least partly prevented, the increase in the required power is detected with a detector, and the control unit disconnects a pressure supply and the movement of the piston stops when a set pressure level is reached or the piston is in an end position.

* * * * *